US012215921B2

(12) United States Patent
Han et al.

(10) Patent No.: US 12,215,921 B2
(45) Date of Patent: Feb. 4, 2025

(54) PHOTOELECTRIC HYDROGEN PRODUCTION ENERGY STORAGE AND COLD ENERGY RECOVERY COUPLED DRY ICE PRODUCTION DEVICE AND USE METHOD

(71) Applicant: HANGZHOU OXYGEN PLANT GROUP CO., LTD., Hangzhou (CN)

(72) Inventors: Yisong Han, Hangzhou (CN); Fang Tan, Hangzhou (CN); Xudong Peng, Hangzhou (CN); Lei Yao, Hangzhou (CN); Liangying Li, Hangzhou (CN); Jiawei Wang, Hangzhou (CN)

(73) Assignee: HANGZHOU OXYGEN PLANT GROUP CO., LTD., Hangzhou (CN)

( * ) Notice: Subject to any disclaimer, the term of this patent is extended or adjusted under 35 U.S.C. 154(b) by 238 days.

(21) Appl. No.: 18/154,040

(22) Filed: Jan. 13, 2023

(65) Prior Publication Data

US 2023/0228485 A1 Jul. 20, 2023

(30) Foreign Application Priority Data

Jan. 17, 2022 (CN) ..... 202210046797.3

(51) Int. Cl.
*F25J 1/00* (2006.01)
*F25J 1/02* (2006.01)

(52) U.S. Cl.
CPC ..... *F25J 1/001* (2013.01); *F25J 1/0027* (2013.01); *F25J 1/0072* (2013.01); *F25J 1/0234* (2013.01);

(Continued)

(58) Field of Classification Search
None
See application file for complete search history.

(56) References Cited

U.S. PATENT DOCUMENTS 3,144,316 A * 8/1964 Stengel ..... F25J 1/0247 62/616
3,300,991 A * 1/1967 Carney ..... F25J 1/0204 62/172

(Continued)

FOREIGN PATENT DOCUMENTS

EP 2474800 A2 * 7/2012 ..... F25J 1/0027
JP H0565518 A * 3/1993

*Primary Examiner* — Jenna M Maroney
(74) *Attorney, Agent, or Firm* — Proi Intellectual Property US

(57) ABSTRACT

A photoelectric hydrogen production energy storage and cold energy recovery coupled dry ice production device and a use method are disclosed. The device comprises a photoelectric conversion liquid hydrogen energy storage unit, photoelectricity participates in electrolysis of water in the storage unit to prepare hydrogen, and surplus hydrogen meeting downstream process requirements is liquefied in the unit; liquid hydrogen is output, so that intermittent photoelectric energy is converted into hydrogen energy to be stored. When hydrogen production through electrolysis of water is insufficient but industrial hydrogen is continuously used, high-grade and low-grade cold energy of low-temperature liquid hydrogen serving as cold sources in the unit is recovered from industrial tail gas purified $CO_2$ and air separation nitrogen, liquid nitrogen and liquid $CO_2$ are output and used for the storage unit and dry ice production respectively, and the liquid hydrogen is reheated and supplied to a downstream process.

4 Claims, 1 Drawing Sheet

(52) U.S. Cl.
CPC ..... *F25J 1/0257* (2013.01); *F25J 2215/10* (2013.01); *F25J 2215/80* (2013.01); *F25J 2260/20* (2013.01); *F25J 2260/30* (2013.01)

(56) References Cited

U.S. PATENT DOCUMENTS

| | | | | |
|---|---|---|---|---|
| 2010/0084256 | A1* | 4/2010 | Vandor | B01D 53/1475 202/175 |
| 2014/0245779 | A1* | 9/2014 | Bohra | F25J 1/0015 62/611 |
| 2023/0138866 | A1* | 5/2023 | Han | F25J 1/0234 205/637 |

* cited by examiner

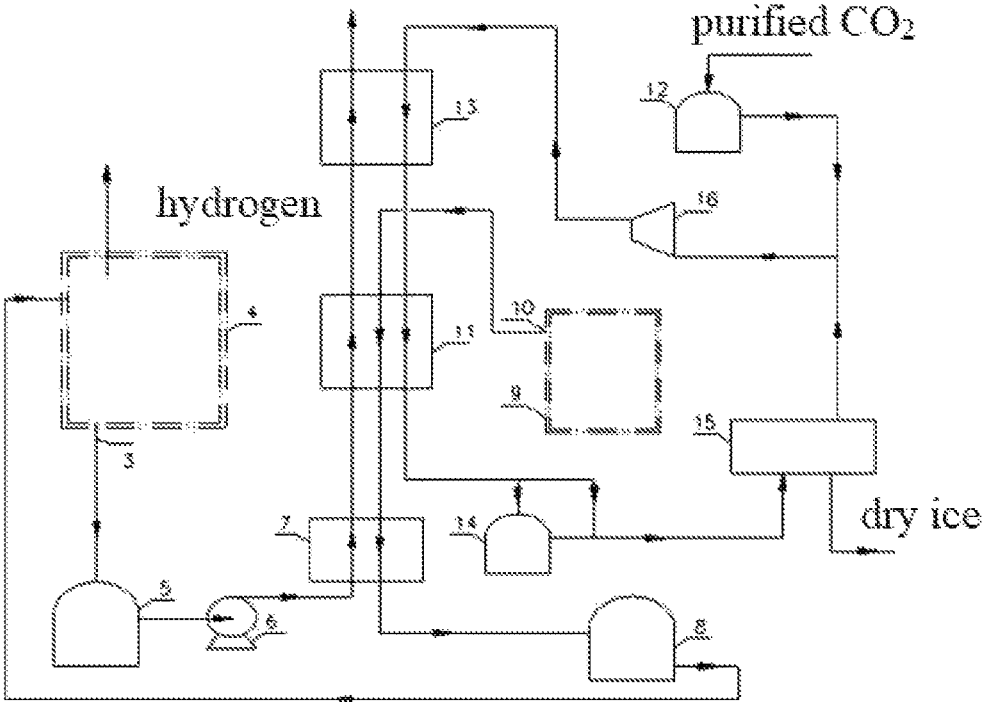
purified $CO_2$
hydrogen
dry ice
12
13
18
4
10
11
9
15
3
7
14
2
6
8

PHOTOELECTRIC HYDROGEN PRODUCTION ENERGY STORAGE AND COLD ENERGY RECOVERY COUPLED DRY ICE PRODUCTION DEVICE AND USE METHOD

TECHNICAL FIELD

The present disclosure relates to the field of energy conversion and cold energy recovery, in particular to a photoelectric hydrogen production energy storage and cold energy recovery coupled dry ice production device and a use method.

BACKGROUND

In recent years, the accelerated consumption of fossil fuels has led to more and more environmental problems, and the content of $CO_2$ in the exhaust gas of various industrial uses is quite high. Controlling the emission of greenhouse gas $CO_2$ has attracted worldwide attention. In addition to directly reducing the amount of $CO_2$, more importantly, $CO_2$ is further recycled from industrial tail gas, which not only can reduce environmental pollution and promote the development of low-carbon economy, but also can increase economic benefits for enterprises, which has very important environmental, social and economic significance. Dry ice, that is, solid carbon dioxide, is widely used in many fields, such as mold cleaning, petrochemical industry, printing industry, food refrigeration, fire fighting, medicine and health, etc., because of its easy volatilization, non-toxicity, tasteless performance, and no liquid formation or residue during phase change. At present, domestic and foreign $CO_2$ industrial liquefaction usually pressurizes atmospheric $CO_2$ gas to 1.6~2.5 MPa by three-stage compression, which is cooled and liquefied by a refrigeration unit, and the liquefied $CO_2$ is expanded by throttling to prepare dry ice. This process consumes a lot of energy for the compression of carbon dioxide and the refrigeration capacity of the refrigeration unit. Therefore, how to effectively reduce the system energy consumption is the main improvement direction and goal of dry ice preparation technology.

With the rapid development of economy in China, the demand for hydrogen in various industries, especially coal chemical industry, is increasing year by year. In the process of hydrogen production by electrolysis of water, no pollution gas is discharged, and the products are only hydrogen and oxygen, which is the preferred method for preparing hydrogen. Green solar power generation can provide energy source for hydrogen production by electrolysis of water, liquefy and store the surplus hydrogen produced when the photoelectric power is sufficient, and vaporize the stored liquid hydrogen when the photoelectric power is insufficient to supply the liquid hydrogen to the downstream process pipe network, thus meeting the demand of continuously using industrial hydrogen. At present, the process of hydrogen liquefaction is very mature. However, there is a great loss of cold energy in the process of energy releasing, vaporization and reuse of liquid hydrogen. Generally, a liquid hydrogen vaporizer uses a natural ventilation and air bathing manner, which fails to realize the optimized recovery of cold energy when vaporizing liquid hydrogen at a low temperature of about 20K, resulting in waste of cold energy and cold pollution. The cold energy utilization technology of liquid hydrogen at a low temperature of about 20K is combined with liquid $CO_2$ and the dry ice preparation technology, which not only can significantly reduce the working pressure of liquid $CO_2$ and a dry ice preparation system and the load of a refrigeration device, reduce the energy consumption and cost in the preparation process of liquid $CO_2$ and dry ice, promote the recovery of $CO_2$ from industrial tail gas and reduce carbon emissions, but also effectively improve the energy utilization rate of low-temperature liquid hydrogen, reduce the environmental cold pollution resulted from liquid hydrogen gasification using air in the traditional process, help to promote the healthy development of the low-temperature liquid hydrogen industry, and enjoy good environmental and social benefits.

SUMMARY

The technical problem to be solved by the present disclosure is to provide a route of a photoelectric hydrogen production energy storage and cold energy recovery coupled dry ice production process, which is used for solving the problems of intermittence of photovoltaic power generation, low efficiency of industrial tail gas $CO_2$ recycling, low energy utilization rate of low-temperature liquid hydrogen and high energy consumption of dry ice preparation.

In order to achieve the above purpose, the present disclosure uses the following technology: a photoelectric hydrogen production energy storage and cold energy recovery coupled dry ice production device, which comprises a photoelectric conversion liquid hydrogen energy storage unit and a dry ice production unit with optimized recovery of liquid hydrogen cold energy, wherein the photoelectric conversion liquid hydrogen energy storage unit and the dry ice production unit with optimized recovery of liquid hydrogen cold energy share a hydrogen-carbon dioxide heat exchanger II, a hydrogen-nitrogen heat exchanger and a hydrogen-carbon dioxide heat exchanger I, wherein the photoelectric conversion liquid hydrogen energy storage unit is further provided with a hydrogen liquefaction unit, an air separation device and a liquid nitrogen storage tank, the liquid nitrogen storage tank is connected with the hydrogen liquefaction unit, the hydrogen liquefaction unit is connected with a low-temperature liquid hydrogen storage tank through a liquid hydrogen pipeline, hydrogen prepared by photovoltaic power generation is refrigerated and liquefied by self-expansion after exchanging heat with liquid nitrogen from the liquid nitrogen storage tank in the mature hydrogen liquefaction unit, and is sent to the low-temperature liquid hydrogen storage tank through the liquid hydrogen pipeline for storage, the process of photoelectric conversion of liquid hydrogen is completed, the low-temperature liquid hydrogen storage tank is connected to the hydrogen-nitrogen heat exchanger, the hydrogen-carbon dioxide heat exchanger I and the hydrogen-carbon dioxide heat exchanger II in sequence, a low-temperature liquid hydrogen pump is provided between the low-temperature liquid hydrogen storage tank and the hydrogen-nitrogen heat exchanger, the air separation device is connected to the hydrogen-carbon dioxide heat exchanger I and the hydrogen-nitrogen heat exchanger through a nitrogen pipeline in sequence, and finally the product liquid nitrogen is stored in the liquid nitrogen storage tank for recycling.

Preferably, the dry ice production unit with optimized recovery of liquid hydrogen cold energy is further provided with a $CO_2$ storage tank, a dry ice machine and a liquid $CO_2$ storage tank, wherein the $CO_2$ storage tank and the dry ice machine are connected with the hydrogen-carbon dioxide heat exchanger II and the hydrogen-carbon dioxide heat exchanger I through a tee pipeline in sequence, one end of the hydrogen-carbon dioxide heat exchanger I is connected to the liquid $CO_2$ storage tank, and the other end thereof is connected to the dry ice machine through a pipeline to form a loop.

Preferably, the hydrogen-nitrogen heat exchanger, the hydrogen-carbon dioxide heat exchanger I and the hydrogen-carbon dioxide heat exchanger II has one of a shell-and-tube structure, a plate-fin structure and a coiled-tube structure or a combination thereof.

Preferably, the low-temperature liquid hydrogen storage tank, the liquid nitrogen storage tank and the low-temperature liquid $CO_2$ storage tank use a Dewar tank or a low-temperature storage tank.

Preferably, the low-temperature liquid hydrogen pump has a piston or centrifugal structure.

A use method of the photoelectric hydrogen production energy storage and cold energy recovery coupled dry ice production device is provided, wherein the method comprises the following steps:

step 1: hydrogen prepared by photovoltaic power generation is refrigerated and liquefied by self-expansion after exchanging heat with liquid nitrogen from the liquid nitrogen storage tank in the mature hydrogen liquefaction unit, and is sent to the low-temperature liquid hydrogen storage tank through the liquid hydrogen pipeline for storage, and the process of photoelectric conversion of liquid hydrogen is completed;

step 2: nitrogen from the air separation device is sent to the hydrogen-carbon dioxide heat exchanger I through a nitrogen pipeline for heat exchange and precooling, and the pre-cooled nitrogen is stored in a liquid nitrogen storage tank by heat exchange and liquefaction with liquid hydrogen through a hydrogen-nitrogen heat exchanger, which is used for step 1;

step 3: liquid hydrogen in the low-temperature liquid hydrogen storage tank is pressurized by a low-temperature liquid hydrogen pump and is sent to the hydrogen-nitrogen heat exchanger, a hydrogen-carbon dioxide heat exchanger I and a hydrogen-carbon dioxide heat exchanger II in sequence, and then is sent to a downstream process pipe network after being reheated;

step 4: normal-temperature $CO_2$ from a gas $CO_2$ storage tank is pre-mixed with the low-temperature $CO_2$ gas in a dry ice machine, the mixed $CO_2$ is compressed by a $CO_2$ compressor and then is sent to the hydrogen-carbon dioxide heat exchanger II for further heat exchange, cooling, and pre-cooling, the pre-cooled $CO_2$ is sent to the hydrogen-carbon dioxide heat exchanger I for heat exchange and liquefaction and is stored in a liquid $CO_2$ storage tank, and the pressurized liquid $CO_2$ in the storage tank is finally sent to the dry ice machine to prepare dry ice, in which part of the liquid $CO_2$ absorbs heat, heats up and vaporizes into low-temperature gas to enter a circulation loop, and the other part of the liquid $CO_2$ solidifies into dry ice and is sent to a dry ice storage tank;

the step 1 occurs when the photoelectric power is sufficient, after hydrogen prepared by the photoelectric electrolysis of water meets downstream process requirements, surplus hydrogen is liquefied in the photoelectric conversion liquid hydrogen energy storage unit, and liquid hydrogen is output to convert intermittent photoelectric energy into hydrogen energy for storage; the step 2, the step 3 and the step 4 are operated at the same time, and the hydrogen-carbon dioxide heat exchanger II, the hydrogen-nitrogen heat exchanger and the hydrogen-carbon dioxide heat exchanger I are heat exchangers shared by the photoelectric conversion liquid hydrogen energy storage unit and the dry ice production unit with optimized recovery of liquid hydrogen cold energy.

The present disclosure has the following beneficial effects.

Intermittent photoelectric energy is stored in the form of liquid hydrogen, so as to effectively solve the problem that it is difficult to supply hydrogen continuously for industry due to photoelectric fluctuation. The process of optimized recovery of cold energy uses the high-grade and low-grade cold energy during liquid hydrogen vaporization to prepare liquid nitrogen and dry ice, respectively, which effectively reduces the device investment and the operation cost. In the process route of the present disclosure, the cold energy utilization technology of liquid hydrogen at a low temperature of about 20K is combined with the liquid $CO_2$ and dry ice preparation technology, which can significantly reduce the energy consumption and cost in the preparation process of liquid $CO_2$ and dry ice, promote the recovery of $CO_2$ from industrial tail gas and reduce carbon emissions, and at the same time, which can effectively improve the energy utilization rate of low-temperature liquid hydrogen, reduce the environmental cold pollution resulted from the traditional process, and promote the healthy development of the low-temperature liquid hydrogen industry.

BRIEF DESCRIPTION OF THE DRAWINGS

FIG. 1 is a schematic structural diagram of the present disclosure.

DETAILED DESCRIPTION OF THE EMBODIMENTS

The present disclosure will be described in detail with reference to the attached drawings hereinafter. As shown in FIG. 1, a photoelectric hydrogen production energy storage and cold energy recovery coupled dry ice production device comprises a photoelectric conversion liquid hydrogen energy storage unit and a dry ice production unit with optimized recovery of liquid hydrogen cold energy. The photoelectric conversion liquid hydrogen energy storage unit and the dry ice production unit with optimized recovery of liquid hydrogen cold energy share a hydrogen-carbon dioxide heat exchanger II13, a hydrogen-nitrogen heat exchanger 7 and a hydrogen-carbon dioxide heat exchanger I11. The photoelectric conversion liquid hydrogen energy storage unit is further provided with a hydrogen liquefaction unit 4, an air separation device 9 and a liquid nitrogen storage tank 8. The liquid nitrogen storage tank 8 is connected with the hydrogen liquefaction unit 4. The hydrogen liquefaction unit 4 is connected with a low-temperature liquid hydrogen storage tank 5 through a liquid hydrogen pipeline 3. Hydrogen prepared by photovoltaic power generation is refrigerated and liquefied by self-expansion after exchanging heat with liquid nitrogen from the liquid nitrogen storage tank 8 in the mature hydrogen liquefaction unit 4, and is sent to the low-temperature liquid hydrogen storage tank 5 through the liquid hydrogen pipeline 3 for storage. The process of photoelectric conversion of liquid hydrogen is completed. The low-temperature liquid hydrogen storage tank 5 is connected to the hydrogen-nitrogen heat exchanger 7, the hydrogen-carbon dioxide heat exchanger I11 and the hydrogen-carbon dioxide heat exchanger II13 in sequence, and a low-temperature liquid hydrogen pump 6 is provided between the low-temperature liquid hydrogen storage tank 5 and the hydrogen-nitrogen heat exchanger 7. The air separation device 9 is connected to the hydrogen-carbon dioxide heat exchanger I11 and the hydrogen-nitrogen heat exchanger 7 through a nitrogen pipeline 10 in sequence, and finally the product liquid nitrogen is stored in the liquid nitrogen storage tank 8 for recycling. The dry ice production unit with optimized recovery of liquid hydrogen cold energy is further provided with a $CO_2$ storage tank 12, a dry ice machine 15 and a liquid $CO_2$ storage tank 14, wherein the $CO_2$ storage tank 12 and the dry ice machine 15 are connected with the hydrogen-carbon dioxide heat exchanger II13 and the hydrogen-carbon dioxide heat exchanger I11 through a tee pipeline in sequence. One end of the hydrogen-carbon dioxide heat exchanger I11 is connected to the liquid $CO_2$ storage tank 14, and the other end thereof is connected to the dry ice machine 15 through a pipeline to form a loop. The hydrogen-nitrogen heat exchanger 7, the hydrogen-carbon dioxide heat exchanger I11 and the hydrogen-carbon dioxide heat exchanger II13 has one of a shell-and-tube structure, a plate-fin structure and a coiled-tube structure or a combination thereof. The low-temperature liquid hydrogen storage tank 5, the liquid nitrogen storage tank 8 and the low-temperature liquid $CO_2$ storage tank 14 use a Dewar tank or a low-temperature storage tank. The low-temperature liquid hydrogen pump 6 has a piston or centrifugal structure.

A use method of the photoelectric hydrogen production energy storage and cold energy recovery coupled dry ice production device is provided, wherein the method comprises the following steps:

step 1: hydrogen prepared by photovoltaic power generation is refrigerated and liquefied by self-expansion after exchanging heat with liquid nitrogen from the liquid nitrogen storage tank 8 in the mature hydrogen liquefaction unit 4, and is sent to the low-temperature liquid hydrogen storage tank 5 through the liquid hydrogen pipeline 3 for storage, and the process of photoelectric conversion of liquid hydrogen is completed;

step 2: nitrogen from the air separation device 9 is sent to the hydrogen-carbon dioxide heat exchanger I11 through a nitrogen pipeline 10 for heat exchange and precooling, and the pre-cooled nitrogen is stored in a liquid nitrogen storage tank 8 by heat exchange and liquefaction with liquid hydrogen through a hydrogen-nitrogen heat exchanger 7, which is used for step 1;

step 3: liquid hydrogen in the low-temperature liquid hydrogen storage tank 5 is pressurized by a low-temperature liquid hydrogen pump 6 and is sent to the hydrogen-nitrogen heat exchanger 7, a hydrogen-carbon dioxide heat exchanger I11 and a hydrogen-carbon dioxide heat exchanger II13 in sequence, and then is sent to a downstream process pipe network after being reheated;

step 4: normal-temperature $CO_2$ from a gas $CO_2$ storage tank 12 is pre-mixed with the low-temperature $CO_2$ gas in a dry ice machine, the mixed $CO_2$ is compressed by a $CO_2$ compressor 16 and then is sent to the hydrogen-carbon dioxide heat exchanger II13 for further heat exchange, cooling, and pre-cooling, the pre-cooled $CO_2$ is sent to the hydrogen-carbon dioxide heat exchanger I11 for heat exchange and liquefaction and is stored in a liquid $CO_2$ storage tank 14, and the pressurized liquid $CO_2$ in the storage tank is finally sent to the dry ice machine 15 to prepare dry ice, in which part of the liquid $CO_2$ absorbs heat, heats up and vaporizes into low-temperature gas to enter a circulation loop, and the other part of the liquid $CO_2$ solidifies into dry ice and is sent to a dry ice storage tank;

the step 1 occurs when the photoelectric power is sufficient, after hydrogen prepared by the photoelectric electrolysis of water meets downstream process requirements, surplus hydrogen is liquefied in the photoelectric conversion liquid hydrogen energy storage unit, and liquid hydrogen is output to convert intermittent photoelectric energy into hydrogen energy for storage; the step 2, the step 3 and the step 4 are operated at the same time, and the hydrogen-carbon dioxide heat exchanger II13, the hydrogen-nitrogen heat exchanger 7 and the hydrogen-carbon dioxide heat exchanger I11 are heat exchangers shared by the photoelectric conversion liquid hydrogen energy storage unit and the dry ice production unit with optimized recovery of liquid hydrogen cold energy.

Specific embodiments:

For example, nitrogen of about 0.15 MPa at 25° C. exchanges heat with low-temperature hydrogen in the hydrogen-carbon dioxide heat exchanger I11. The pre-cooled nitrogen further exchanges heat with liquid hydrogen from the low-temperature liquid hydrogen storage tank 5 pressurized to about 5.5 MPa by the low-temperature liquid hydrogen pump 6 in the hydrogen-nitrogen heat exchanger 7, fully recovers high-grade cold energy of liquid hydrogen of about K, and then is liquefied and stored in the low-temperature liquid nitrogen storage tank 8. Normal-temperature and normal-pressure $CO_2$ from a $CO_2$ storage tank is mixed with the low-temperature $CO_2$ gas of about 0.11 MPa in the dry ice machine. The mixed $CO_2$ is compressed to about 0.6 MPa by the $CO_2$ compressor 16, and then is sent to the hydrogen-carbon dioxide heat exchanger II13 for heat exchange with low-temperature hydrogen of about 5.5 MPa from the hydrogen-carbon dioxide heat exchanger I11 for pre-cooling. The pre-cooled $CO_2$ is then sent to the hydrogen-carbon dioxide heat exchanger I11 for further heat exchange with low-temperature hydrogen from the hydrogen-nitrogen heat exchanger 7, and then is liquefied and sent to the liquid $CO_2$ storage tank 14 for storage. The pressurized liquid $CO_2$ is sent to the dry ice machine 15 for throttling and expansion to prepare dry ice, in which part of the liquid $CO_2$ absorbs heat and vaporizes into low-temperature $CO_2$ gas to enter the circulation loop, and the other part of the liquid $CO_2$ solidifies into dry ice and is sent to the dry ice storage tank for dry ice users. In this process route, liquid hydrogen of about 20K is sent to a downstream process pipe network after being reheated by the hydrogen-nitrogen heat exchanger 7, the hydrogen-carbon dioxide heat exchanger I11 and the hydrogen-carbon dioxide heat exchanger II13.

In the present disclosure, when photovoltaic power generation is insufficient, liquid hydrogen is vaporized and supplied to the downstream process through the dry ice production unit with optimized recovery of liquid hydrogen cold energy. In the process of vaporization of liquid hydrogen at a low-temperature of about 20K, the recovery of high-grade and low-grade cold energy is optimized to prepare liquid nitrogen from nitrogen and prepare dry ice from industrial tail gas purified $CO_2$ at low cost.

What is claimed is:

1. A photoelectric hydrogen production energy storage and cold energy recovery coupled dry ice production device, which comprises a photoelectric conversion liquid hydrogen energy storage unit and a dry ice production unit with optimized recovery of liquid hydrogen cold energy, wherein the photoelectric conversion liquid hydrogen energy storage unit and the dry ice production unit with optimized recovery of liquid hydrogen cold energy share a hydrogen-carbon dioxide heat exchanger II (13), a hydrogen-nitrogen heat exchanger (7) and a hydrogen-carbon dioxide heat exchanger I (11), wherein the photoelectric conversion liquid hydrogen energy storage unit is further provided with a hydrogen liquefaction unit (4), an air separation device (9) and a liquid nitrogen storage tank (8), the liquid nitrogen storage tank (8) is connected with the hydrogen liquefaction unit (4), the hydrogen liquefaction unit (4) is connected with a low-temperature liquid hydrogen storage tank (5) through a liquid hydrogen pipeline (3), hydrogen prepared by photovoltaic power generation is refrigerated and liquefied by self-expansion after exchanging heat with liquid nitrogen from the liquid nitrogen storage tank (8) in the hydrogen liquefaction unit (4), and is sent to the low-temperature liquid hydrogen storage tank (5) through the liquid hydrogen pipeline (3) for storage, the process of photoelectric conversion of liquid hydrogen is completed, the low-temperature liquid hydrogen storage tank (5) is connected to the hydrogen-nitrogen heat exchanger (7), the hydrogen-carbon dioxide heat exchanger I (11) and the hydrogen-carbon dioxide heat exchanger II (13) in sequence, a low-temperature liquid hydrogen pump (6) is provided between the low-temperature liquid hydrogen storage tank (5) and the hydrogen-nitrogen heat exchanger (7), the air separation device (9) is connected to the hydrogen-carbon dioxide heat exchanger I (11) and the hydrogen-nitrogen heat exchanger (7) through a nitrogen pipeline (10) in sequence, and finally the product liquid nitrogen is stored in the liquid nitrogen storage tank (8) for recycling.

2. The photoelectric hydrogen production energy storage and cold energy recovery coupled dry ice production device according to claim 1, wherein the dry ice production unit with optimized recovery of liquid hydrogen cold energy is further provided with a $CO_2$ storage tank (12), a dry ice machine (15) and a liquid $CO_2$ storage tank (14), wherein the $CO_2$ storage tank (12) and the dry ice machine (15) are connected with the hydrogen-carbon dioxide heat exchanger II (13) and the hydrogen-carbon dioxide heat exchanger I (11) through a tee pipeline in sequence, one end of the hydrogen-carbon dioxide heat exchanger I (11) is connected to the liquid $CO_2$ storage tank (14), and the other end thereof is connected to the dry ice machine (15) through a pipeline to form a loop.

3. The photoelectric hydrogen production energy storage and cold energy recovery coupled dry ice production device according to claim 2, wherein the hydrogen-nitrogen heat exchanger (7), the hydrogen-carbon dioxide heat exchanger I (11) and the hydrogen-carbon dioxide heat exchanger II (13) has one of a shell-and-tube structure, a plate-fin structure and a coiled-tube structure or a combination thereof.

4. The photoelectric hydrogen production energy storage and cold energy recovery coupled dry ice production device according to claim 1, wherein the low-temperature liquid hydrogen pump (6) has a piston or centrifugal structure.

* * * * *